United States Patent [19]

Mayrhofer

[11] Patent Number: 4,957,156

[45] Date of Patent: Sep. 18, 1990

[54] CONTINUOUS CASTING MOLD ARRANGEMENT FOR CASTING BILLETS AND BLOOMS

[75] Inventor: Karl Mayrhofer, Naarn, Austria

[73] Assignee: Voest-Alpine Industrieanlagenbau Gesellschaft m.b.H., Austria

[21] Appl. No.: 361,149

[22] Filed: Jun. 5, 1989

[30] Foreign Application Priority Data

Jun. 8, 1988 [DE] Fed. Rep. of Germany ..... 3819493

[51] Int. Cl.[5] ..... B22D 11/10

[52] U.S. Cl. ..... 164/504; 164/468

[58] Field of Search ..... 164/466, 502, 468, 504

[56] References Cited

U.S. PATENT DOCUMENTS

| | | | |
|---|---|---|---|
| 2,944,309 | 7/1960 | Schaaber | 164/504 |
| 4,026,346 | 5/1977 | Birat et al. | 164/504 |
| 4,137,961 | 2/1979 | Mola | 164/504 |
| 4,294,304 | 10/1981 | Delassus | 164/468 |

FOREIGN PATENT DOCUMENTS

| | | | |
|---|---|---|---|
| 359225 | 3/1978 | Austria . | |
| 2441448 | 7/1980 | France | 164/504 |
| 63-60056 | 3/1988 | Japan | 164/468 |

OTHER PUBLICATIONS

Pp. 419 to 427 From The Handbook on Continuous Casting by Erhard Herrman, Aluminium-Verlag GmbH, Dusseldorf, 1958.

*Primary Examiner*—Richard K. Seidel

*Attorney, Agent, or Firm*—Handal & Morofsky

[57] ABSTRACT

There is disclosed a continuous casting mold for casting billets and blooms including a stirring means to produce a rotating electromagnetic field or force. It is sought to use a continuous casting mold of this type facultatively with free-stream casting or with immerged-tube casting. The continuous casting mold includes at least one stirring means which is displaceable over the height of the continuous casting mold and is fixable in different height positions.

5 Claims, 2 Drawing Sheets

CONTINUOUS CASTING MOLD ARRANGEMENT FOR CASTING BILLETS AND BLOOMS

The invention relates to a continuous casting mold for billets and blooms, in particular a continuous casting mold for steel casting, comprising a stirring means to produce a rotating electromagnetic field of force.

It is known (AT-B—359,225, U.S. Pat. Nos. 4,026,346, 2,944,309) to influence the solidification of continuously cast high-melting metals, such as steel, by applying rotating electromagnetic fields of force, thus attaining metallurgical and technological advantages, in particular a more uniform and fine texture of the cast strand, a uniform distribution of non-metallic inclusions, an improved heat elimination, etc. According to the prior art, the application of the rotary field is effected in the region of the mold or slightly below the same.

Depending on the melt quality, the casting of strands having billet or bloom cross sections takes place either according to the free-stream casting technique, in which a casting stream emerging freely from a tundish positioned above the continuous casting mold flows into the continuous casting mold and penetrates into the melt present within the mold cavity, or according to the immerged-tube casting technique, in which a casting tube arranged at the tundish is immerged in the melt present within the mold cavity such that the casting stream gets into the melt in the mold cavity by avoiding air contact. The casting level is covered by casting powder.

In the latter case, the melt is protected from reoxidation by the immerged tube and by the casting powder, wherein, however, care has to be taken when providing electromagnetic agitation that not too vigorous a movement of the melt occurs on the casting level, because in that case casting powder, which serves to lubricate the strand shell during sliding at the mold, will get into the interior of the strand, being included there.

In contrast, with free-stream casting, with which oil applied at the mold walls is used for lubrication instead of casting powder, it is sought to provoke a melt rotation as strong as possible (2 to 3 Hertz) on the casting level in order to let the gases carried away with the casting stream that penetrates the melt in the continuous casting mold more easily ascend towards the casting level, thereby inducing what is called a washout effect.

Known continuous casting molds comprising stirring means differ in terms of construction according to immerged-tube or free-stream casting, the configuration of the stirring means, in particular, being selected according to the casting process applied.

In steelworks, there is often the problem that a wide range of different steel grades is to be cast continuously, the immerged-tube casting process being preferred for some steel grades—primarily steel grades killed by aluminum—and the free-stream casting process being preferred for other steel grades—such as steels killed by silicon—, for metallurgical reasons. Since the exchange of continuous casting molds requires too much time when changing from the free-stream casting process to the immerged-tube casting process and vice versa, in particular when casting small quantities, some compromise with respect to structural configuration that is suited more or less to both casting processes has had to be made in order to be able to carry out both processes with one and the same continuous casting mold, yet no optimum results have been obtained for either casting process.

The invention aims at avoiding these difficulties and has as its object to provide a continuous casting mold of the initially defined kind, which may be used both for the immerged-tube casting process and for the free-stream casting process such that an optimum texture of the cast strand and as few inclusions as possible will be guaranteed with both casting processes.

In accordance with the invention this object is achieved in that the continuous casting mold for facultatively casting by the free-stream casting process or by the immerged-tube casting process comprises at least one stirring means, which is displaceable over the height of the continuous casting mold and is fixable in different height positions. The continuous casting mold according to the invention allows both free-stream casting and immerged-tube casting to be realized without having to carry out any conversion work. In order to achieve an optimum stirring effect with free-stream casting, the stirring means is moved into an upper position, whereby the melt constituting the casting level and the melt present immediately therebelow are stirred such that gases penetrated into the melt together with the casting stream will be effectively washed out. In contrast, with immerged-tube casting, the stirring means is moved into a position more remote from the casting level such that no stirring takes place on the casting level itself in order to avoid movement of the bath at the casting level, which, in this case, is covered by casting powder. Due to the fact that an optimumly positioned stirring means is always available to either of the two casting processes, it is possible to do with a lower stirring performance with both casting processes, i.e., to consume less energy, than with continuous casting molds that do not have such dispositions.

In order to avoid too much screening of the electromagnetic field of force by the continuous casting mold, the stirring means suitably is arranged within a mold internal space extending over approximately the entire height of the continuous casting mold and passed by a coolant, the stirring means being arranged in a closed casing inserted in the mold internal space passed by the coolant, a stirring means coolant flowing through the closed casing. The arrangement of the stirring means in a separate closed casing within the mold cavity has the advantage that the coolant recirculating system for the stirring means may be adapted to the amount of coolant required by the same irrespective of the internal cooling of the continuous casting mold.

Advantageously, at least one stirring means coolant duct enters into the closed casing near its lower end and at least one stirring means coolant duct enters near its upper end.

According to a preferred embodiment, the stirring means is movable in height within the interior of the closed casing, which extends over almost the total height of the continuous casting mold. Suitably, the stirring means coolant supply and discharge ducts are controlled by valves and the height position of the stirring means is fixable by generating a differential pressure of the coolant above and below the stirring means.

A preferred embodiment is characterized in that the stirring means is sealed relative to the closed casing by a sealing means, such as a gasket, leaving a flow cross section of a predetermined size relative to the closed casing.

The invention will now be explained in more detail with reference to the accompanying drawings, wherein.

Figure 1:
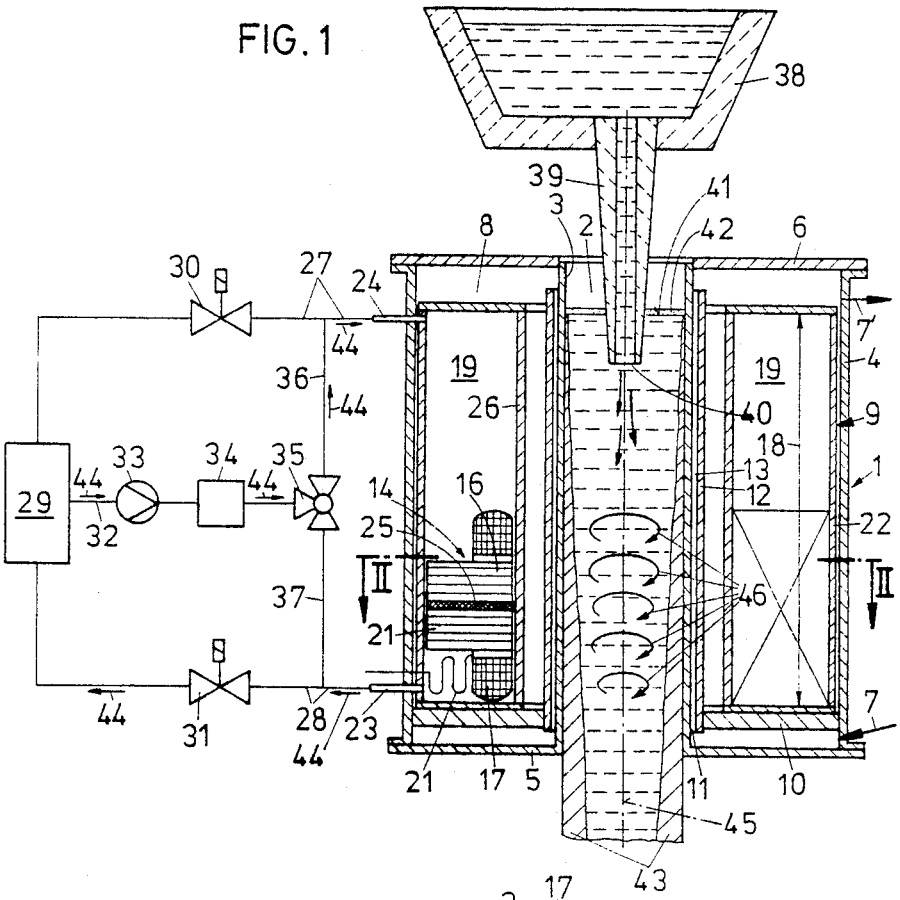
FIGS. 1 and 3 represent one and the same continuous casting mold in the longitudinal section, once (FIG. 1) with immerged-tube casting, once (FIG. 3) with free-stream casting.
Figure 2:
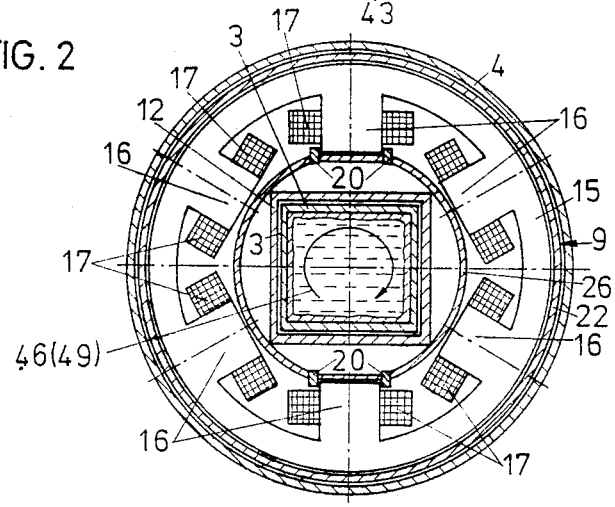
FIG. 2 is a section perpendicular to the longitudinal axis of the continuous casting mold, according to FIGS. 1 and 3, each along the line of section II—II of these Figures.

A continuous casting mold 1 for casting billets, which is designed as a tube mold comprises an approximately square straight and vertically extending mold cavity 2 delimited by a tube 3 of copper or a copper alloy. About this tube 3, an outer jacket 4 is provided, which is tightly connected to the tube 3 via annular base and cover plates 5, 6. On the lower end of the continuous casting mold a mold cooling-water inlet 7, on the upper end a mold cooling-water outlet 7', are provided.

Within the mold internal space 8 formed by the outer jacket 4 and the tube 3 and through which a coolant flows, a closed circular-ring-cylindrical casing 9 is stationarily installed, resting on a flange 10 arranged above the base plate 5. This flange 10 is fastened to the outer jacket 4, reaching towards the tube 3 on leaving free a gap 11. On this flange 10, a water conducting jacket 12 is provided, leaving a flow gap 13 for the mold coolant relative to the tube 3.

Within the closed casing 9, which is made of rust-resistant steel, a stirring means 14 is installed, which serves to generate a rotating electromagnetic field of force. The stirring means 14 has an annular iron core 15 of dynamo sheet, on which radially inwardly extending projections 16 are provided to each receive one coil 17 of copper wire. The stirring means 14 extends over approximately half the height 18 of the internal space 19 of the casing 9 in terms of height and is displaceable within the casing 9 over its height 18. Vertical guiding ledges 20 arranged on the internal wall of the casing serve to guide the stirring means 14, two oppositely disposed projections 16 of the iron core 15 being guided along the same. The guiding ledges 20 serve to introduce into the casing 9 the reaction forces developed at the generation of an electromagnetic field of force. An electric connection 21 for the stirring means is led through the external wall 22 of the casing and has a length within the interior 19 of the casing 9 that enables the stirring means 14 to be displaced over the entire height 18 of the interior 19 of the casing.

On the lower and on the upper ends of the casing 9, one nozzle 23, 24 for cooling medium, for instance, oil or water, is each provided. Displacement of the stirring means 14 is effected with the help of the cooling medium flowing through the casing 9 by changing the flow direction of the cooling medium.

To this end, a horizontal annular gasket 25 is installed in the region of the iron core 15, which subdivides the circular-ring-cylindrical interior 19 enclosed by the casing into two parts, i.e., one upper part and one lower part.

The annular sealing gasket, which extends substantially from the external wall 22 to the internal wall 26 of the casing 9, has at least one recess forming a well defined flow cross section for the cooling medium. This recess, e.g., an annular gap towards the internal wall 26, is of such a size that a differential pressure may form between the inlet and outlet sides of the cooling medium with the appropriate flow direction and amount of cooling medium, which differential pressure moves the stirring means 14 from the lower position illustrated in FIG. 1 into the upper position illustrated in FIG. 3, retaining it there.

In order not to stress the guiding ledges 20 when displacing the stirring means 14, the adjustment in height of the stirring means 14 is effected prior to its setting into operation.

The coolant recirculating system for the stirring means includes two main ducts 27, 28 each leading from a nozzle 23, 24 of the casing 9 to a heat exchanger 29, a magnetic valve 30, 31 being incorporated in each main duct 27, 28 to connect the heat exchanger 29 to either of the two main ducts 27, 28 or disconnect it therefrom. From the heat exchanger, a return duct 32, over a pump 33 and a filter 34, leads to a three-way valve 35, from which one branch duct 36, 37 each enters into a main duct 27 or 28, respectively. By appropriately switching the valves 30, 31 and 35, it is possible to supply coolant to the stirring means 14 via the upper nozzle 24 and to discharge it from the lower nozzle 23 and to reverse the coolant recirculating system such that the coolant is supplied by the lower nozzle 23 and discharged by the upper nozzle 24.

A tundish 38 is positioned above the continuous casting mold 1. According to FIG. 1, an immerged tube 39 fastened to the tundish reaches centrically into the mold cavity 2 and, on its free end, has an outflow opening 40 directed downwards. The casting level 41 lies above this outflow opening 40 and is covered by a casting powder 42. The strand shell 43 forming at the tube 3 is illustrated schematically.

With the immerged-tube casting process, the stirring means 14 is displaced into the lower end position; the coolant flow in the interior 19 of the casing 9 is effected from top to bottom, as is apparent from the directional arrows 44 entered in FIG. 1. The stirring means 14 generates a rotational movement in the melt about the longitudinal axis 45 of the mold cavity 2, as is illustrated by arrows 46.

Figure 3:
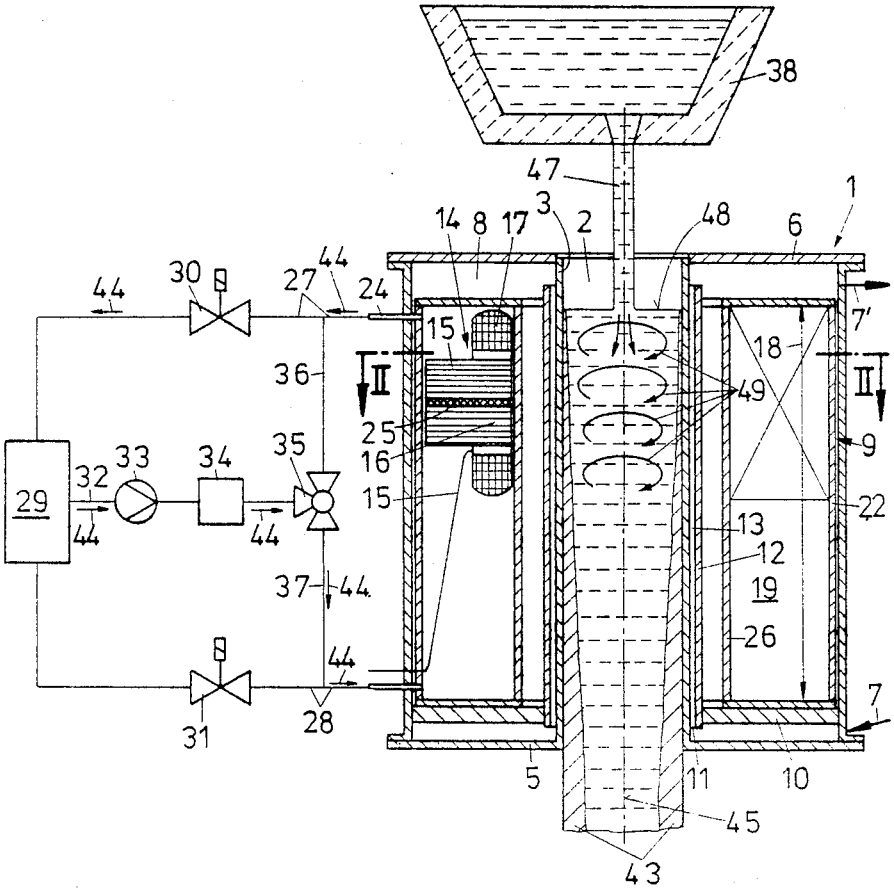

According to FIG. 3, a casting stream 47 freely running out of the tundish 38 enters the mold cavity 2. In this case, the stirring means 14 is displaced into the upper end position—the coolant flow in the interior 19 of the casing 9 is effected from bottom to top—, thus creating a stirring movement of the melt consituting the casting level 48 and of the melt being immediately therebelow, as is indicated by arrows 49.

The invention is not limited to the embodiment represented in the drawings, but may be modified in various aspects. Thus, the mold cavity 2 also may be curved in the longitudinal direction (in case of a so-called arcuate mold) or may be arranged in a manner deviating from the vertical line.

What I claim is:

1. In a continuous casting mold arrangement for casting billets and blooms of the type including a continuous casting mold having an upper end or run-in side and a lower end or run-out side defining a mold cavity therebetween, and a stirring means adapted to generate a rotating electromagnetic field of force, the improvements wherein:

(a) said continuous casting mold is adapted to facultatively provide for casting by the free-stream casting technique or by the immerged-tube casting technique and comprises at least one stirring means displaceable over the height of said continuous casting mold and fixable in different height positions;

(b) a mold internal space extending approximately over the height of said continuous casting mold;

(c) a coolant flowing through said mold internal space and said stirring means being arranged within said mold internal space;

(d) a substantially closed casing inserted in said mold internal space through which said coolant flows, said stirring means being arranged within said closed casing;

(e) a stirring means coolant flowing through said closed casing;

(f) at least one first coolant duct entering into said closed casing near its lower end and at least one second coolant duct entering into said casing near its upper end, wherein said closed casing has an interior extending over almost the entire height of said continuous casting mold and said stirring means is displaceable in height within said interior; and (g) further comprising valve means valve means for controlling the supply and discharge of said stirring means coolant and for fixing the height position of said stirring means by creating a differential pressure of said stirring means coolant above and below said stirring means.

2. A continuous casting mold arrangement as set forth in claim 1, further comprising a sealing means adapted to seal said stirring means relative to said closed casing by leaving a flow cross section of predetermined size.

3. A continuous casting mold arrangement as set forth in claim 2, wherein said sealing means is a gasket.

4. A continuous casting mold arrangement comprising:

(a) a continuous casting mold having a height with a top feed end and a lower end defining a mold cavity therebetween;

(b) an electromagnetic stirring means disposed around said continuous casting mold and moveable over the height of said continuous casting mold;

(c) an outer jacket disposed around said electromagnetic stirring means and said continuous casting mold defining an interior mold coolant space around said continuous mold approximately over the height between said top feed end and said lower end;

(d) an inner annular casing with inner and outer walls, said inner annular casing being positioned within said outer jacket and containing said electromagnetic stirring means, said inner annular casing defining a stirring means coolant space, said inner casing being substantially closed except for at least two stirring means coolant ducts, one of said two stirring means coolant ducts being an inlet duct entering into said inner casing at a height corresponding approximately to said lower end of said continuous casting mold and the other of said two stirring means cooling ducts being an exit duct entering into said inner casing at a height corresponding approximately to said top feed end of said continuous casting mold, said electromagnetic stirring means along the height of said continuous casting mold within said inner casing; and (e) an annular gasket associated with said electromagnetic stirring means positioned, dimensioned and configured to contact both said inner and outer walls of said inner annular casing and defining at least one recess to allow coolant to flow from said inlet duct to said exit duct, said recess positioned, dimensioned and configured to create a coolant pressure differential, dependent upon a rate of flow of said coolant, whereby said annular gasket holds said stirring means at a desired height determined by said coolant flow.

5. In a continuous casting apparatus of the type comprising a hollow continuous casting mold having a height; an electromagnetic stirring means disposed around said continuous casting mold and moveable over the height of said mold, a mold coolant space providing for mold coolant flow; and a stirring means coolant space providing for stirring means coolant flow; the improvement comprising valving means, associated with said stirring means within said stirring means coolant space for creating a coolant pressure difference across said valving means associated with said stirring means, the position of said stirring means with respect to the height of said mold being determined by said pressure difference.

* * * * *